US008050913B2

(12) United States Patent
Lee et al.

(10) Patent No.: US 8,050,913 B2
(45) Date of Patent: Nov. 1, 2011

(54) METHOD AND APPARATUS FOR IMPLEMENTING FIXED CODEBOOKS OF SPEECH CODECS AS COMMON MODULE

(75) Inventors: Kang-eun Lee, Gangneung-si (KR); Do-hyung Kim, Hwaseong-si (KR); Chang-yong Son, Gunpo-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1002 days.

(21) Appl. No.: 11/930,750

(22) Filed: Oct. 31, 2007

(65) Prior Publication Data

US 2009/0037169 A1 Feb. 5, 2009

(30) Foreign Application Priority Data

Aug. 2, 2007 (KR) ..... 10-2007-0077810

(51) Int. Cl.
*G10L 19/12* (2006.01)

(52) U.S. Cl. ..... 704/222; 704/221; 704/223; 704/220

(58) Field of Classification Search ..... 704/222, 704/221, 223, 220
See application file for complete search history.

(56) References Cited

U.S. PATENT DOCUMENTS 6,556,966 B1 * 4/2003 Gao ..... 704/220
2004/0044524 A1 * 3/2004 Minde et al. ..... 704/220
2004/0109471 A1 * 6/2004 Minde et al. ..... 370/465
2006/0074641 A1 * 4/2006 Goudar et al. ..... 704/219
2006/0206319 A1 * 9/2006 Taleb ..... 704/223

OTHER PUBLICATIONS

Microsoft Press Computer Dictionary, p. 227, (Kim Fryer et al. eds., 3d ed. 1997).
Merriam-Webster Online Dictionary (2011), http://www.merriam-webster.com/dictionary/hardware (last visited Feb. 15, 2011).
Oxford Dictionaries Online (2010), http://oxforddictionaries.com/view/entry/m_en_us1253600#DWS-M_EN_US-194774 (last visited Feb. 15, 2011).

* cited by examiner

*Primary Examiner* — Qi Han
(74) *Attorney, Agent, or Firm* — Staas & Halsey LLP

(57) ABSTRACT

A method and apparatus for implementing fixed codebooks as a common module are provided. In the method of implementing fixed codebooks of a plurality of speech codecs as a common module, it is possible to include only a part excluding fixed codebooks in a communication terminal or communication system, support various speech codecs without using a chip with high price and high performance, and reduce a memory space that is occupied by the speech codecs by generating a track of a fixed codebook corresponding to a speech codec based on information on the speech codec among the plurality of speech codecs and selecting a codebook vector corresponding to a target signal among codebook vectors constructed with combinations of pulses represented by the generated track. In addition, it is possible to reduce processing complexity as compared with a case of embodying the common fixed codebook module in software by embodying the common fixed codebook module in hardware. In addition, it is possible to improve the entire voice processing performance by applying the latest fixed codebook searching algorithm only to the common fixed codebook, thereby easily applying the latest fixed codebook searching algorithm to the entire voice codec.

12 Claims, 7 Drawing Sheets

FIG. 7

```
CodeBookSearch( dp, ps, alp, ip[], Oip[], *A, *D )
{
  for i=0 to dp
  {
    ip[dp] = T[dp][i]
    ps = ps + T[dp][i]
    alp = alp + Φ[T[dp][i]][T[dp][i]]
    for j=0 to dp-1
      alp = alp + Φ[ip[j]][T[dp][i]]
    if dp == N-1
    {
      ps = ps * ps
      if (ps * *A) > (*D * alp)
      {
        *A = alp
        *D = ps
        for j=0 to dp-1
          Oip[j] = ip[j]
        Oip[dp] = T[dp][i]
      }
    }
    else
    {
      CodeBookSearch( dp+1, ps, alp, ip, Oip, A, D)
    }
  }
}
```

METHOD AND APPARATUS FOR IMPLEMENTING FIXED CODEBOOKS OF SPEECH CODECS AS COMMON MODULE

CROSS-REFERENCE TO RELATED PATENT APPLICATION

This application claims the benefit of Korean Patent Application No. 10-2007-0077810, filed on Aug. 2, 2007, in the Korean Intellectual Property Office, the disclosure of which is incorporated herein in its entirety by reference.

BACKGROUND OF THE INVENTION

1. Field of the Invention

The present invention relates to fixed codebooks of speech codecs, and more particularly, to a method and apparatus for implementing fixed codebooks in a code excited linear prediction (hereinafter, referred to as CELP) structure and an algebraic codebook technique.

2. Description of the Related Art

The term "codec" is a compound word made up of the word "coder" for converting an analogue signal into a digital signal and "decoder" for converting a digital signal into an original analogue signal. A speech codec serves to convert an analogue voice signal into a digital signal composed of a relatively small amount of data, and transmits the digital signal to a distant place. The speech codec serves to convert a received digital signal into an analogue voice signal recognizable by a human being. Most speech codecs developed so far use algebraic codebooks as fixed codebooks. The entire structure of the algebraic codebooks is the same as a code excited linear prediction (CELP) structure. A technique obtained by combining the algebraic codebook technique with the CELP structure is referred to as an algebraic code excited linear prediction (hereinafter, referred to as ACELP) technique. Current speech codecs are the ACELP.

FIG. 1 illustrates an entire structure of an ACELP technique. As shown in FIG. 1, a speech codec with a general code excited linear prediction (CELP) structure 120 is constructed with three modules. A fixed codebook module 121 generates an excitation signal and transmits the generated excitation signal to an adaptive codebook module 122. The adaptive codebook module 122 functions as a human vocal chord. The adaptive codebook module 122 adds a pitch component to the excitation signal and transmits excitation signal to a linear predictive coding (LPC) synthesis module 123. The LPC synthesis module 123 generates a final voice signal by mimicking the shape of a human mouth by using a tenth all-poll filter in the case of a narrow band signal or a sixteenth all-poll filter in the case of a wide band signal. The aforementioned speech codec structure is referred to as the CELP structure 120. The ACELP technique was developed by combining an algebraic codebook technique 110, which is one of various algorithms of a fixed codebook, with the CELP structure 120. Hereinafter, when the algebraic codebook is exemplified, the algebraic codebook may be used as a term indicating a fixed codebook.

However, although a single technique such as ACELP is used, various speech codecs are used in connection with various systems, standardization groups, and available fields. Accordingly, a user has to use a device in which a plurality of speech codecs are embedded or has to use a plurality of devices accessible to various systems so as to access the various systems. For example, when a user has to access various systems such as code division multiple access 2000 (CDMA2000), wideband code division multiple access (WCDMA), and voice-over-Internet protocol (VoIP) systems by using one communication terminal, various speech codecs currently used or likely to be used in the near future, such as enhanced variable rate codecs (EVRCs), 13k qualcomm code excited linear predictive coding (13k-QCELP), adaptive multi-rate (AMR), adaptive multi-rate wideband (AMR-WB), G.729, G.729.1, and the like have to be embedded in a chip included in the communication terminal. Accordingly, a voice processing chip has to have high performance so as to include the various speech codecs. This increases the size and cost of the chip.

FIG. 2 is a graph showing a calculation amount ratio of each module of a speech codec. In general, a module that performs the largest amount of calculation is an algebraic codebook module. FIG. 2 illustrates complexity of each module measured by an encoder of an AMR-WB that is a standard codec of the third generation partnership project (3GPP) and a standard speech codec of the telecommunication standardization sector of the international telecommunication union (ITU-T). In FIG. 2, an amount of calculation performed by an algebraic codebook module 201 is greater than 54% of the total calculation amount. Accordingly, it is necessary to decrease the complexity of the fixed codebook that performs the largest amount of calculation in the calculation of the speech codec to which the ACELP technique is applied, when the various speech codecs are embedded in a chip.

SUMMARY OF THE INVENTION

The present invention provides a method and apparatus for implementing fixed codebooks capable of removing inconvenience that various speech codecs required by various systems so as to allow a communication system for processing a voice signal to access different networks have to be embedded in a single communication terminal and solving a problem that costs is increased due to a high performance chip needed to process a voice signal by excessively using a memory for the speech codecs in the communication terminal.

According to an aspect of the present invention, there is provided a method of implementing fixed codebooks of a plurality of speech codecs as a common module, the method comprising: generating a track of a fixed codebook corresponding to a speech codec based on information on the speech codec among the plurality of speech codecs; and selecting a codebook vector corresponding to a target signal among codebook vectors constructed with combinations of pulses represented by the generated track.

According to another aspect of the present invention, there is provided a computer-readable recording medium having embodied thereon a computer program for executing the aforementioned method of implementing fixed codebooks of a plurality of speech codecs as a common module.

According to an aspect of the present invention, there is provided an apparatus for implementing fixed codebooks of a plurality of speech codecs, the apparatus comprising: a track generator generating a track of a fixed codebook corresponding to a speech codec based on information on the speech codec among the plurality of speech codecs; and a codebook selector selecting a codebook vector corresponding to a target signal among codebook vectors constructed with combinations of pulses represented by the generated track.

The present invention provides a method and apparatus for implementing fixed codebooks capable of including only a part excluding fixed codebooks in a communication terminal or communication system by embodying fixed codebooks commonly used for various speech codecs as a common module, supporting various speech codecs without using a chip with high price and high performance, and reducing a memory space that is occupied by the speech codecs, in order to remove inconvenience that various speech codecs required by various systems so as to allow a conventional communication system for processing a voice signal to access different networks have to be embedded in a single communication terminal and in order to solve a problem that costs is increased due to a high performance chip needed to process a voice signal by excessively using a memory for the speech codecs in the communication terminal. In addition, it is possible to reduce processing complexity as compared with a case of embodying the common fixed codebook module in software by embodying the common fixed codebook module in hardware. In addition, it is possible to improve the entire voice processing performance by applying the latest fixed codebook searching algorithm only to the common fixed codebook, thereby easily applying the latest fixed codebook searching algorithm to the entire voice codec.

BRIEF DESCRIPTION OF THE DRAWINGS

The above and other features and advantages of the present invention will become more apparent by describing in detail exemplary embodiments thereof with reference to the attached drawings in which:

FIG. 7 illustrates a function of repeatedly searching for a codebook in a codebook selector of a fixed codebook according to an embodiment of the present invention.

DETAILED DESCRIPTION OF THE INVENTION

Hereinafter, the present invention will be described more fully with reference to the accompanying drawings, in which exemplary embodiments of the invention are shown.

Figure 1:
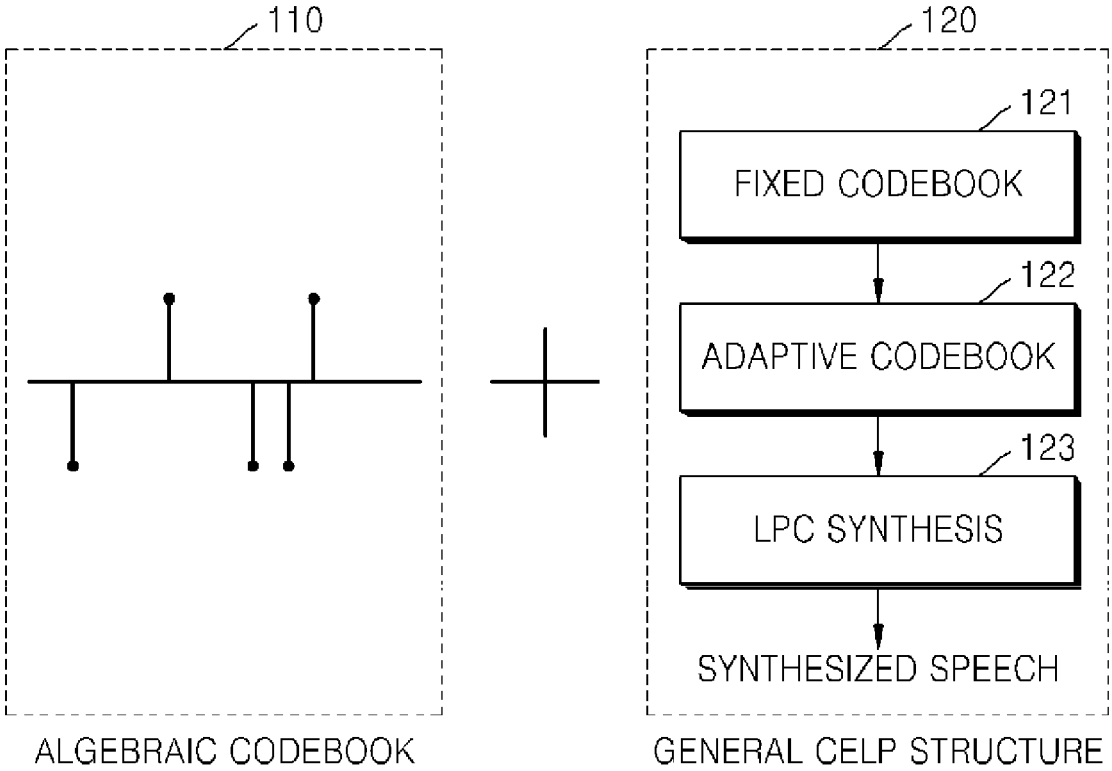
FIG. 1 illustrates an entire structure of an algebraic code excited linear prediction (ACELP) technique.
Figure 2:
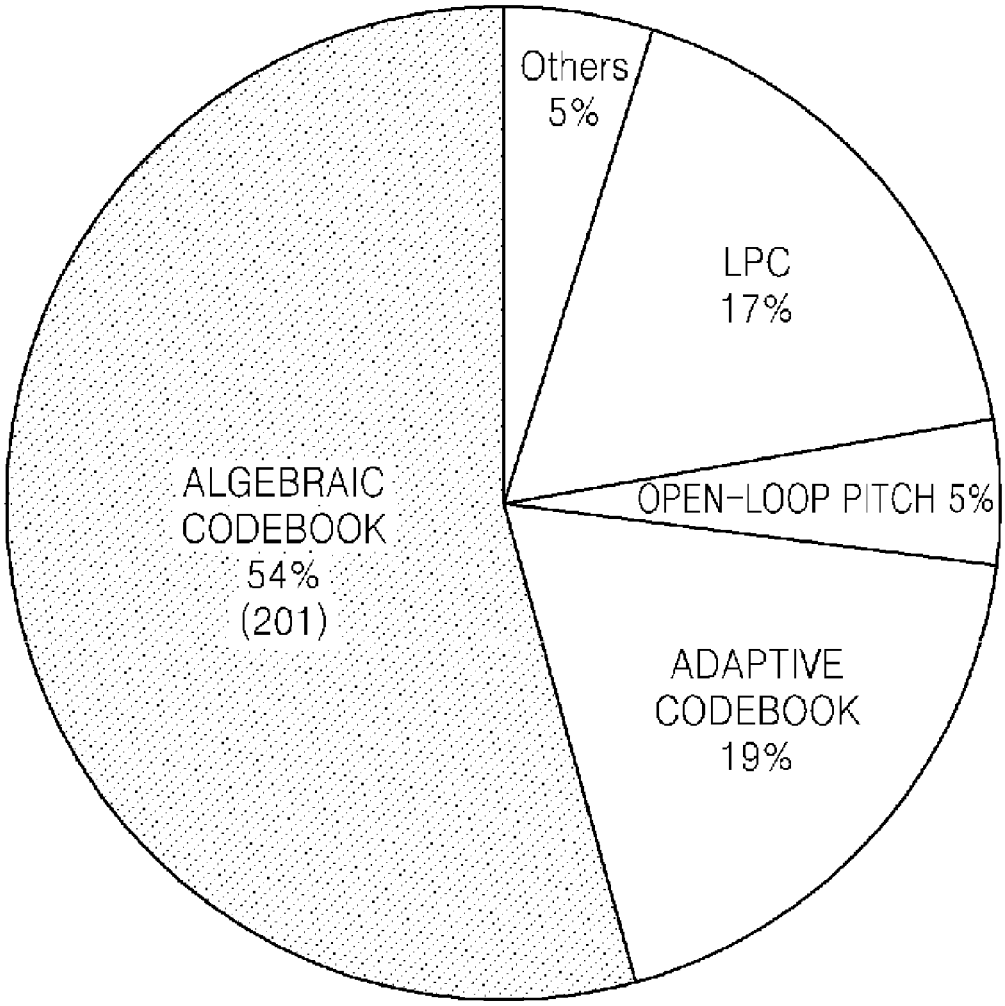
FIG. 2 is a graph showing a calculation amount ratio of each module of a speech codec.
Figure 3:
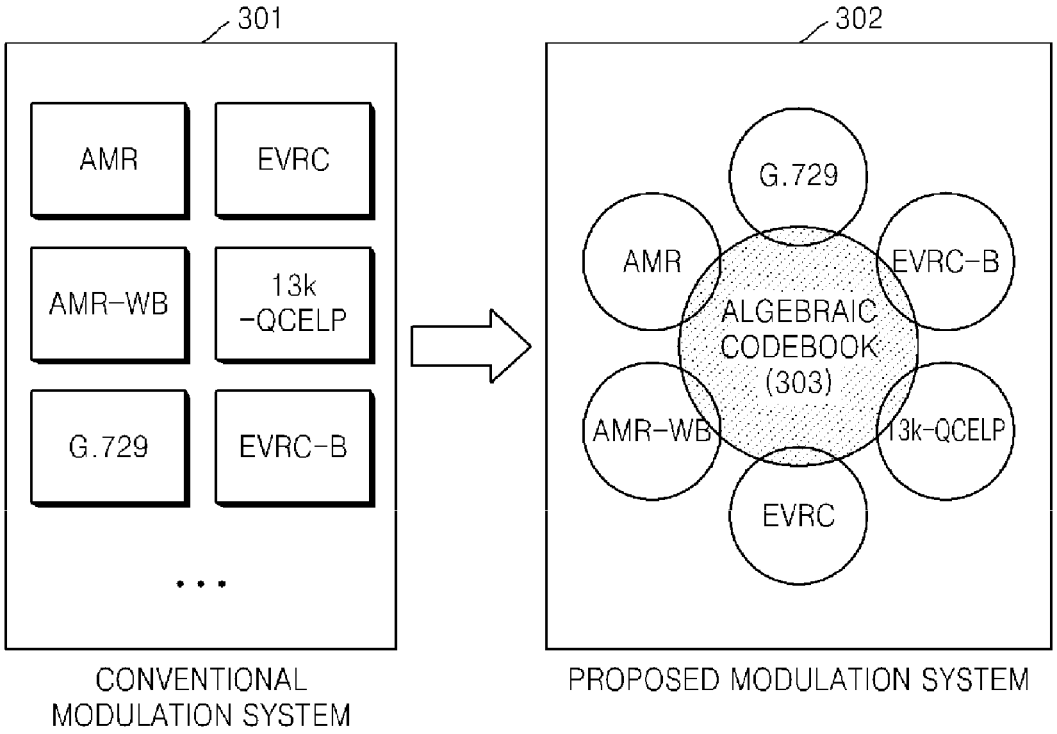
FIG. 3 illustrates a concept of a fixed codebook embodied as a common module according to an embodiment of the present invention.

FIG. 3 illustrates a concept of a fixed codebook embodied as a common module according to an embodiment of the present invention. In this embodiment, a structure obtained by constructing an algebraic codebook module, which is a fixed codebook commonly used for various speech codecs, as a single module is suggested, in consideration of a fact that most existing speech codecs use a code excited linear prediction (CELP) technique using a fixed codebook, specifically, an algebraic code excited linear prediction (ACELP) technique.

A conventional modulation system 301 is embodied so that various speech codecs such as AMR, EVRC, 13k-QCELP, G.729, and the like are embedded in the conventional modulation system 301. Since the conventional modulation system 301 has no common module, various codecs have to be embedded in the conventional modulation system 301. Unlike the conventional modulation system 301, in a speech codec 302 according the embodiment of the present invention, an algebraic codebook 303, which is a fixed codebook, is embodied in each speech codec as a common module. Accordingly, in the embodiment, only the modules except the algebraic codebook have to be embodied in each speech codec based on the algebraic codebook. That is, the voice processing system may be embodied so as to share the algebraic codebook in which each speech codec is optimized and a search module for the algebraic codebook. Hereinafter, basic terminology to be used in an embodiment of FIG. 4 will be briefly described. The structure of the fixed codebook and a method of implementing the fixed codebooks as a common module will be described in detail.

The algebraic codebook uses an interleaved single-pulse permutation (ISPP) structure. The ISPP represents an excitation signal by using a plurality of unit pulses. Each pulse is constructed with an algebraic sign with amplitude of +1 or −1. Accordingly, the algebraic codebook can express various excitation signals by using a small number of bits as compared with another fixed codebook algorithm. Thus, it is possible to efficiently search the algebraic codebook. In general, the excitation signal indicates a remaining signal after allowing an analogue voice signal to pass through an LP analysis, an adaptive codebook, an LPC and a pitch analysis. In the embodiment, the excitation signal indicates a remaining signal that is finally input so as to search for the fixed codebook.

The codebook indicates a representative value of a remaining excitation signal after extracting a formant and a pitch from an analogue voice signal of a human being. The algebraic codebook represents the representative value by using the aforementioned unit pulse of +1 or −1. The algebraic codebook includes information on a position of the unit pulse. A group consisting of positions of a series of pulses is referred to as a track. In the algebraic codebook, a predetermined number of pulses are allocated to a predetermined track in order to effectively model the representatives of the excitation signals. The number of pulse position groups and position information included in the pulse position groups are changed based on the type of the speech codec.

Figure 4:
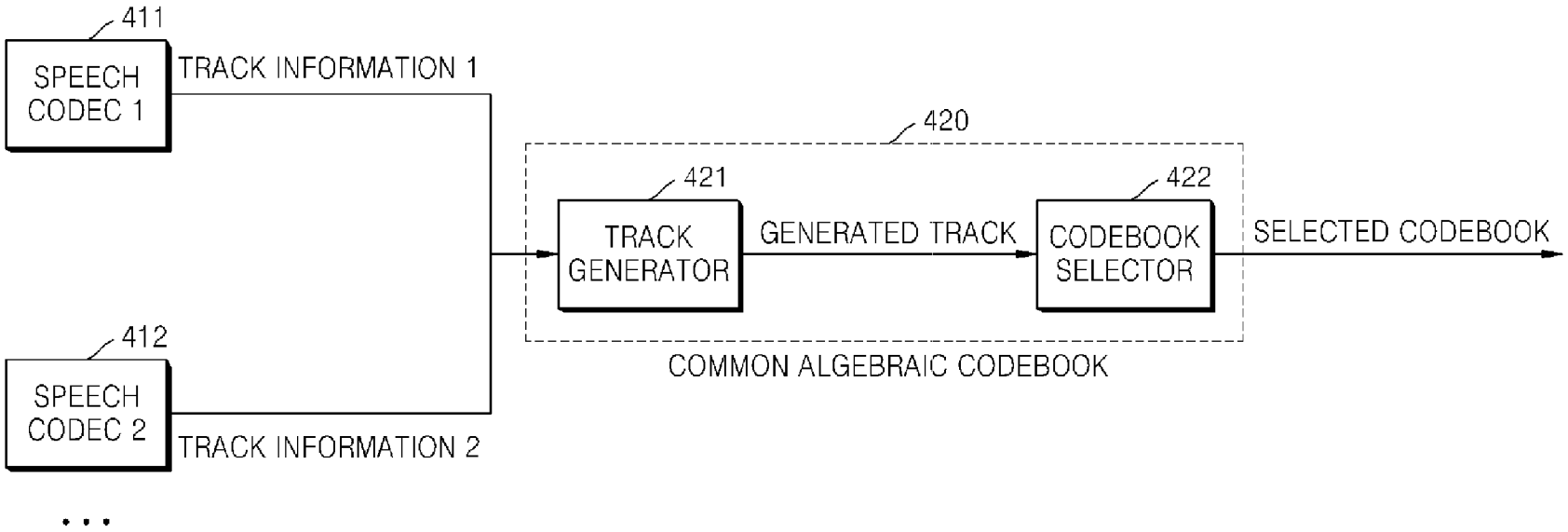
FIG. 4 illustrates a structure of a fixed codebook embodied as a common module according to an embodiment of the present invention.

FIG. 4 illustrates a structure of a fixed codebook embodied as a common module according to an embodiment of the present invention. As shown in FIG. 3, speech codecs 411 and 412 may be various speech codecs. Since the speech codecs commonly use an algebraic codebook module 420, the shown speech codecs 411 and 412 correspond to only a part excluding the algebraic codebook module 420. In the speech codecs, a form of an algebraic codebook is changed based on features such as a frame length, a bit rate, and a bandwidth. Thus, a track indicating the aforementioned pulse group is changed.

In order to search the algebraic codebook through the common algebraic codebook module 420, the algebraic codebook and the track have to be defined. Accordingly, as shown in FIG. 4, the common algebraic codebook 420 includes a track generator 421 and a codebook selector 422. The track generator 421 generates a track by receiving track information from each speech codec 411 and 412. The codebook selector 422 selects an optimal codebook vector based on the generated track. The codebook vector is constructed by selecting at least one pulse for each track. Since the number of pulses to be selected for each track is changed based on the type of the speech codec, the codebook vector that is the combination of the selected pulses is also various.

Next, the optimal codebook vector indicates a codebook vector corresponding to a signal in which a mean-square error (MSE) of a found signal and a target signal is minimized. Here, the found signal indicates a signal found to be most similar to the input excitation signal. The target signal indicates an original input excitation signal. That is, a signal in which a degree of distortion of a signal encoded through the speech codec with respect to the input signal is minimized is regarded as an optimal encoding signal. The codebook vector with respect to a position of which MSE is minimized is selected. Hereinafter, the track information input into the common algebraic codebook module and other input parameters will be described through a practical example of the entire ACELP structure.

Figure 5:
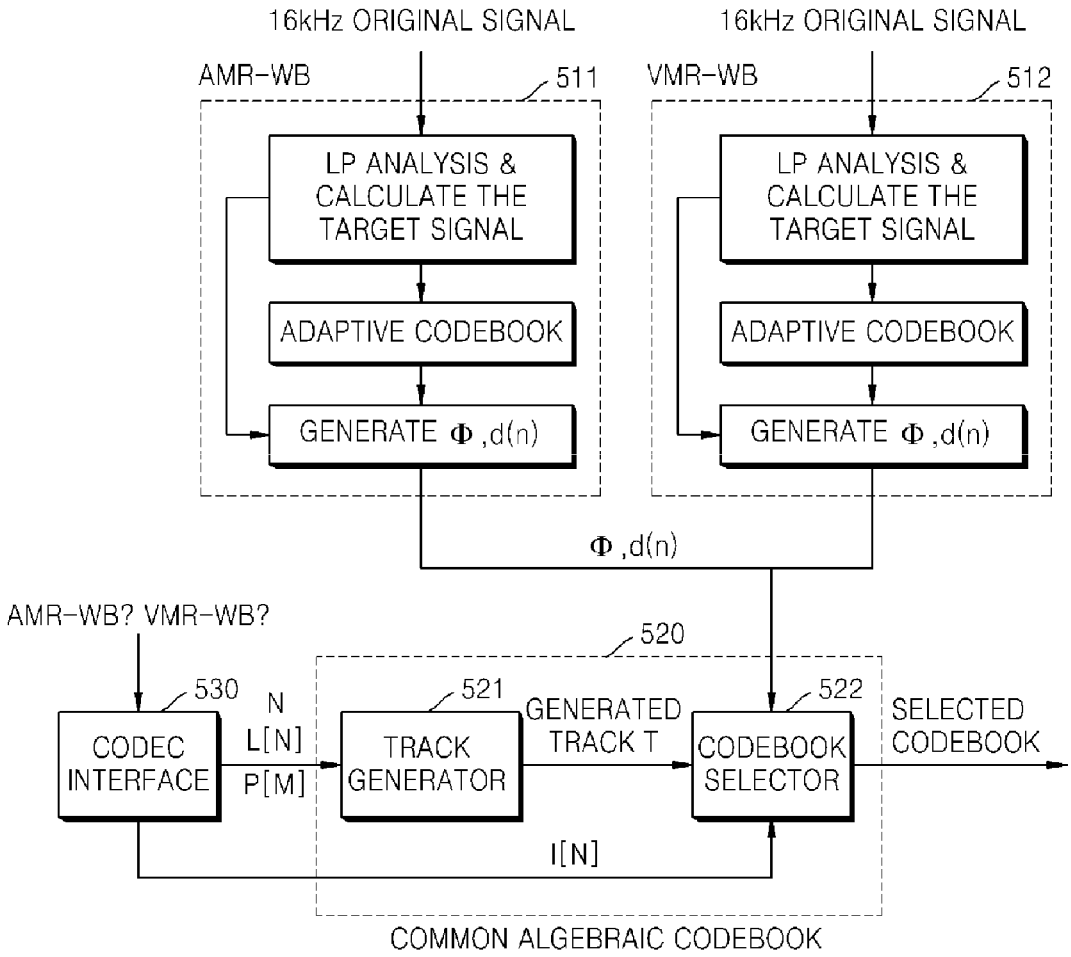
FIG. 5 illustrates a fixed codebook embodied as a common module and input parameters according to an embodiment of the present invention.

FIG. 5 illustrates a fixed codebook embodied as a common module and input parameters according to an embodiment of the present invention. In order to explain the track information and a parameter to be input into the common algebraic codebook module, G.729 speech codec is described as an example. The G.729 speech codec to be described is a standard of ITU speech codec. It will be understood by those of ordinary skill in the art that various speech codecs belonging to the ACELP structure are applicable, in addition to the G.729 speech codec. When the G.729 speech codec is constructed with four unit pulses so as to represent the excitation signal, the excitation signal c(n) will be represented by Equation 1 as follows:

$$c(n)=s_0\delta(n-m_0)+s_1\delta(n-m_1)+s_2\delta(n-m_2)+s_3\delta(n-m_3)\delta(n)\text{:unit pulse} \quad \text{[Equation 1]}$$

where, $s_i$ indicates a sign of an i-th pulse, and $m_i$ indicates a position of the i-th pulse. In the case of G.729, four tracks exist. A pulse is found in each track. The track is constructed as shown in Table 1.

TABLE 1

| Pulse | Sign | Position |
|---|---|---|
| $i_0$ | $s_0$: ±1 | $m_0$: 0, 5, 10, 15, 20, 25, 30, 35 |
| $i_1$ | $s_1$: ±1 | $m_1$: 1, 6, 11, 16, 21, 26, 31, 36 |
| $i_2$ | $s_2$: ±1 | $m_2$: 2, 7, 12, 17, 22, 27, 32, 37 |
| $i_3$ | $s_3$: ±1 | $m_3$: 3, 8, 13, 18, 23, 28, 33, 38, 4, 9, 14, 19, 24, 29, 34, 39 |

As shown in FIG. 4, when a code vector in which the MSE with respect to the target signal is minimized in searching for the fixed codebook is $c_k$, in the code vector $c_k$, a performance value $T_k$ of the code vector $c_k$ is maximized. That is, the performance values $T_k$ of all the selectable code vectors in the searching for the fixed codebook are calculated. It is possible to obtain the optimal code vector $c_k$ by selecting a code vector corresponding to the greatest performance value $T_k$ from among the performance values $T_k$.

$$T_k = \frac{C_k^2}{E_k} = \frac{\left(\sum_{n=0}^{39} d(n)c_k(n)\right)^2}{c_k^t \Phi c_k} \quad \text{[Equation 2]}$$

Here, k is an index of a code vector, $c_k^t$ is a transpose of a code vector $c_k$, and n is used as a sample index. The performance value $T_k$ is defined as a performance value of the code vector $c_k$. A vector d(n) is represented by a correlation equation between the target signal and an impulse response which is Equation 3 as follows:

$$d(n) = \sum_{i=n}^{39} x'(n)h(i-n) \quad \text{[Equation 3]}$$

where x'(n) is a target signal, and h(n) is an impulse response of a synthesis filter. The target signal is a reference signal for measuring performance of each code vector. The target signal is calculated through an LPC searching process and a pitch searching process.

ϕ represents a correlation equation of the impulse response h(n). When H is defined as a lower triangular Toepliz convolution matrix, $\phi=H^tH$ is represented by Equation 4.

$$\phi(i, j) = \sum_{n=j}^{L} h(n-i)h(n-j) \quad \text{[Equation 4]}$$

Since the codebook vector $C_k$ practically includes four non-zero vectors, it is possible to search for a codebook with high speed. A correlation equation of the numerator term of Equation 2 is represented by Equation 5 as follows:

$$C = \sum_{i=0}^{3} s_i d(m_i) = |d(m_0)| + |d(m_1)| + |d(m_2)| + |d(m_3)| \quad \text{[Equation 5]}$$

where, $m_i$ indicates a position of an i-th pulse, and $s_i$ indicates an amplitude of the i-th pulse. An energy equation of the denominator term of Equation 2 is represented by Equation 6.

$$\begin{aligned} E = {} & s_0\begin{pmatrix} s_0\phi(m_0, m_0) + s_1\phi(m_1, m_0) + \\ s_2\phi(m_2, m_0) + s_3\phi(m_3, m_0) \end{pmatrix} + \\ & s_1\begin{pmatrix} s_0\phi(m_0, m_1) + s_1\phi(m_1, m_1) + \\ s_2\phi(m_2, m_1) + s_3\phi(m_3, m_1) \end{pmatrix} + \\ & s_2\begin{pmatrix} s_0\phi(m_0, m_2) + s_1\phi(m_1, m_2) + \\ s_2\phi(m_2, m_2) + s_3\phi(m_3, m_2) \end{pmatrix} + \\ & s_3\begin{pmatrix} s_0\phi(m_0, m_3) + s_1\phi(m_1, m_3) + \\ s_2\phi(m_2, m_3) + s_3\phi(m_3, m_3) \end{pmatrix} \\ = {} & \sum_{i=0}^{3} \phi(m_i, m_i) + 2\sum_{i=0}^{2}\sum_{j=i+1}^{3} s_i s_j \phi(m_i, m_j) \end{aligned} \quad \text{[Equation 6]}$$

In order to reduce complexity of the searching process, in the correlation equation C and the energy E, only a value needed for a practical searching process is calculated before the searching process. Previously calculated values are sequentially stored in the necessary order for the searching process. Thus, it is possible to search for a codebook with high speed. In the correlation equation C, a sign sign[d(i)] and an absolute value are separately stored previously. The energy E is separately stored as a form of Equation 7.

$$\phi'(i,j)=\text{sign}[d(i)]\text{sign}[d(j)]\phi(i,j) \quad \text{[Equation 7]}$$

i=0, . . . , 39 j=i+1, . . . , 39 if i=j, then $$\phi'(i,j)=0.5\phi'(i,j)$$

i=0, . . . , 39

Accordingly, Equation 6 that is the energy term may be represented by Equation 8.

$$E/2 = \phi'(m_0, m_0) + \phi'(m_1, m_1) + \phi'(m_0, m_1) + \phi'(m_2, m_2) + \phi'(m_0, m_2) + + \phi'(m_1, m_2) + \phi'(m_3, m_3) + \phi'(m_0, m_3) + \phi'(m_1, m_3) + \phi'(m_2, m_3) \quad \text{[Equation 8]}$$

Up to now, general contents of searching for the algebraic codebook have been described through the example of G.729.

As described in FIG. 4, a structure of a common algebraic codebook module 520 for searching for an algebraic codebook in FIG. 5 is constructed with a track generator 521 and a codebook searcher 522. First, a codec interface 530 transmits track information corresponding to a speech codec identified by identifying a type of a speech codec currently to be used to the track generator 521 of the common fixed codebook module as an input parameter. As described above, since the structure of the track is changed based on the type of the speech codec, the codec interface 530 serves to allow the track generator 521 to generate a track suitable for the speech codec to be used. Although the codec interface 530 is separately shown in FIG. 5, in practice, it is possible to embody the codec interface 530 so as to be included in the track generator 521.

The track generator 521 generates a track of an algebraic codebook based on the input track information. The track information may include the number N of tracks for the speech codec, the number of positions L[N] included in each track, and position information P[M] included in each track. A defined track T is expressed as a two-dimensional array. Rows indicate tracks. Columns indicate position values of pulses belonging to the tracks.

Next, the codebook selector 522 receives a matrix $\phi$, a correlation value d(n) of a target signal and an impulse response, and the number I[N] of pulses to be found for each track as parameters and selects an optimal codebook vector. As shown in FIG. 4, the optimal codebook vector is selected by searching for the codebook vector in which the MSE is minimized. The procedure of searching for the codebook is described in relation to Equation 2.

A procedure of generating the matrix $\phi$ and the correlation value d(n) of the target signal and the impulse response in FIG. 5 is described through an adaptive multi-rate wideband (AMR-WB) (511) and a variable multi-rate wideband (VMR-WB) (512). The AMR-WB is a speech codec belonging to the third generation partnership project (3GPP) standard group. The VMR-WB is a speech codec belonging to the 3GPP2 standard group. The AMR-WB and the VMR-WB have ACELP structures. Accordingly, in FIG. 5, the AMR-WB 511 and VMR-WB 512 shows an encoding process of the ACELP as follows. First, the target signal is calculated through the LP analysis by receiving a voice signal of 16 kHz. The matrix $\phi$ and the correlation value d(n) of the target signal and impulse response are calculated by allowing the calculation result to pass through the adaptive codebook module. The calculated matrix $\phi$ and the correlation value d(n) are input into the codebook selector 522. Accordingly, the optimal codebook vector is selected.

Figure 6:
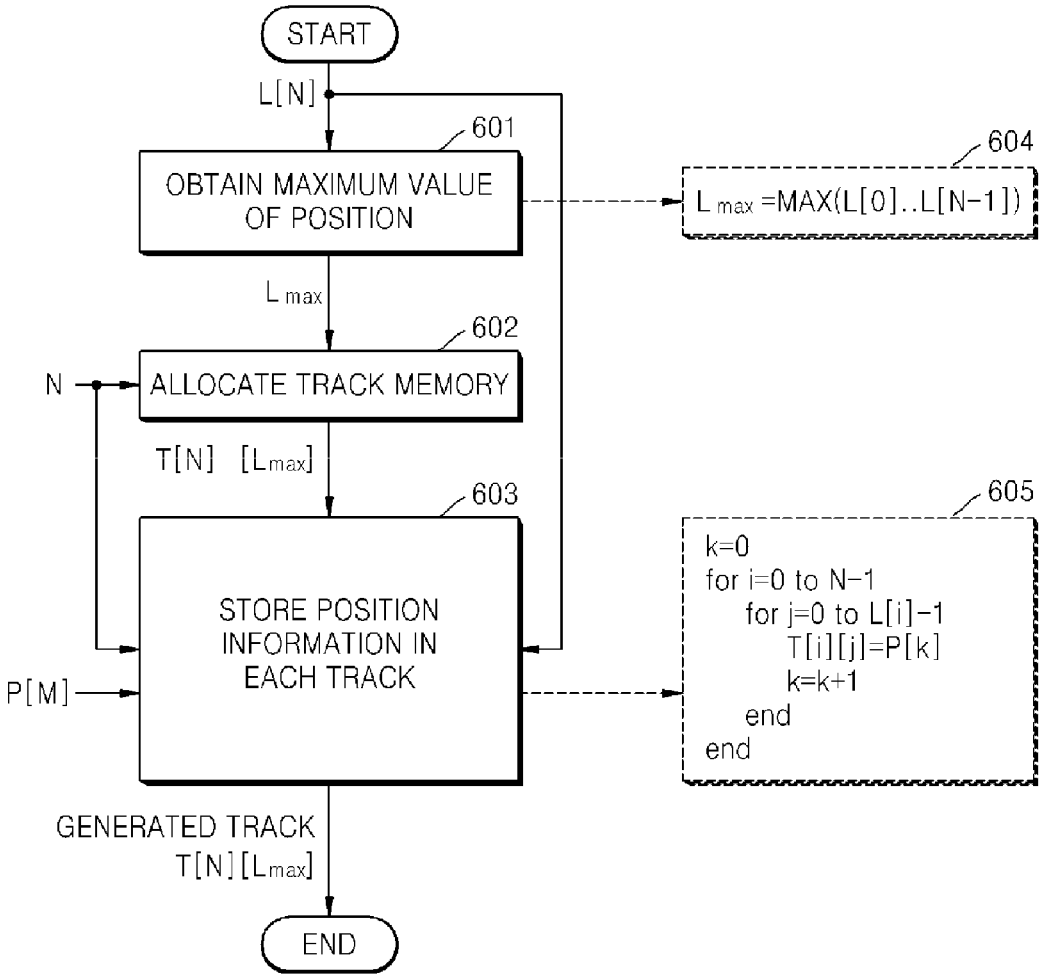
FIG. 6 is a flowchart of a method of generating a track in a track generator of a fixed codebook according to an embodiment of the present invention.

FIG. 6 is a flowchart of a method of generating a track in a track generator of a fixed codebook according to an embodiment of the present invention.

In operation 601, in order to obtain an array size for a track, the maximum value is obtained from the number of positions belonging to each track. As exemplified in Table 1, this is because the number of positions belonging to each track for each speech codec may be different. Accordingly, an equation for searching for the maximum value from the number L[N] of positions included in each track and storing the maximum value in $L_{max}$ is represented as operation 604.

In operation 602, a memory needed to generate a track is allocated based on the maximum value obtained in operation 601. The number of columns in an array T to which the memory is allocated is defined as the number N of the tracks. The number of rows is defined as the $L_{max}$. That is, the array T is represented as $T[N][L_{max}]$.

In operation 603, position information is stored in each track of the array to which the memory is allocated from position information P[M] included in each track. Here, M is the total number of positions. The position information belonging to tracks 0 to N is sequentially stored in the vector P[M]. For example, in the algebraic codebook track of G.729 exemplified in Table 1, the vector P is represented by Equation 9.

$$P=\{0,5,10,15,20,25,30,35,1,6,11,16,21,26,31,36,2,7,12,17,22,27,32,37,3,8,13,18,23,28,33,38,4,9,14,19,24,29,34,39\} \quad \text{[Equation 9]}$$

Operation 605 represents operation 603 as a simple pseudo-code. A procedure of allocating the position information from the vector P[k] in which the position information is stored to a track and storing the position information.

FIG. 7 illustrates a function of repeatedly searching for a codebook in a codebook selection unit of a fixed codebook according to an embodiment of the present invention.

A procedure of searching for the optimal codebook may be constructed with repetitive loops of which the number is the same as the number of tracks. However, since the number of tracks is changed based on the speech codec, the number of repetitions is dynamically constructed in the procedure of searching for the optimal codebook. In FIG. 7, a dynamic loop structure is embodied as a pseudo code by using a recursive method among methods of embodying algorithm. In FIG. 7, a function CodeBookSearch( ) is repeatedly called by increasing an array number for a track until satisfying an end condition of a program. In addition, when a value less than the existing MSE is found by repeatedly calculating an MSE value, an array Oip[]in which the optimal position value is stored is updated.

Although the function embodied by using the recursive method is exemplified among the methods of embodying algorithm, it is possible for those of ordinary skill in the art to embody a method of searching for an optimal codebook by dynamically controlling the number of searching processes by receiving the number of tracks by using various methods of embodying algorithm such as an iterative method, in addition to a recursive method.

Since each speech codec includes a fixed codebook in a conventional technique, the speech codec is embodied as a type of software. Unlike the conventional technique, when a fixed codebook is embodied as a common module according to embodiments of the present invention, it is possible to manufacture only the fixed codebook module commonly used by each speech codec as hardware. A difference between a case where the fixed codebook is manufactured in hardware and a case where the fixed codebook is manufactured in software is exemplified through the AMR-WB as follows. First, when the algebraic codebook is manufactured in hardware, the processing complexity is assumed to be reduced to a tenth of that in the case where the algebraic codebook is manufacture in software. In this case, when the algebraic codebook is manufactured in hardware, the processing complexity is reduced to about 50% of that in the case where the algebraic codebook is manufacture in software. The complexity for each module is represented in Table 2.

TABLE 2

| Module | Complexity ratio (%) Before | After |
|---|---|---|
| LPC | 17 | 17 |
| Open-loop pitch | 5 | 5 |
| Adaptive codebook | 19 | 19 |
| Algebraic codebook | 54 | 5.4 |
| Others | 5 | 5 |
| Total | 100 | 51.4 |

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method of implementing algebraic fixed codebooks of a plurality of speech codecs having an algebraic code excited linear prediction structure (ACELP), as a common module, the method comprising:

(a) obtaining information corresponding to a speech codec among the plurality of speech codecs having the ACELP structure;

(b) generating, using a computer, a track of an algebraic fixed codebook corresponding to the speech codec based on information on the speech codec among the plurality of speech codecs; and (c) selecting a codebook vector corresponding to a target signal among codebook vectors constructed with combinations of pulses represented by the generated track.

2. The method of claim 1, wherein the information includes the number of tracks based on a type of the speech codec, the number of positions of pulses included in each track, and position values of the pulses included in each track.

3. The method of claim 2, wherein (b) comprises:

detecting the maximum value among the number of positions included in each track;

allocating a memory needed for generating the track based on the maximum value; and storing the position values in each track to which the memory is allocated from the position values of the pulses included in each track.

4. The method of claim 1, wherein in (c), a process of searching for a track is repeated in correspondence with the number of tracks, and a codebook vector is selected by selecting a signal in which a difference between the target signal and the found signal is less than an existing difference, whenever performing the process of searching for the track.

5. The method of claim 1, the method further comprising identifying the speech codec from among the plurality of speech codecs having the ACELP structure.

6. A non-transitory computer-readable recording medium having embodied thereon a computer program for executing the method of any one of claims 1 through 4.

7. An apparatus for implementing algebraic fixed codebooks of a plurality of speech codecs having an algebraic code excited linear prediction (ACELP) structure, the apparatus comprising:

a track generator to obtain information corresponding to a speech codec having the ACELP structure, and to generate, using a computer, a track of an algebraic fixed codebook corresponding to the speech codec based on information on the speech codec among the plurality of speech codecs having the ACELP structure; and a codebook selector to select, a codebook vector corresponding to a target signal among codebook vectors constructed with combinations of pulses represented by the generated track.

8. The apparatus of claim 7, wherein the information includes the number of tracks based on a type of the speech codec, the number of positions of pulses included in each track, and position values of the pulses included in each track.

9. The apparatus of claim 8, wherein the track generator detects the maximum value among the number of positions included in each track, allocates a memory needed for generating the track based on the maximum value, and stores the position values in each track to which the memory is allocated from the position values of the pulses included in each track.

10. The apparatus of claim 7, wherein the codebook selector repeats a process of searching for a track in correspondence with the number of tracks, and a codebook vector is selected by selecting a signal in which a difference between the target signal and the found signal is less than an existing difference, whenever performing the process of searching for the track.

11. The apparatus of claim 7, wherein the track generator identifies the speech codec from among the plurality of speech codecs having the ACELP structure.

12. The apparatus of claim 7, wherein the apparatus further comprises a codec interface to identify a type of speech codec from among the plurality of speech codecs having the ACELP structure, and to transmit information corresponding to the speech codec to the track generator.

* * * * *